US010639541B1

(12) United States Patent
Hoback

(10) Patent No.: US 10,639,541 B1
(45) Date of Patent: May 5, 2020

(54) BINGO CARD ORGANIZING ASSEMBLY

(71) Applicant: Tammy Hoback, Livermore, CA (US)

(72) Inventor: Tammy Hoback, Livermore, CA (US)

( * ) Notice: Subject to any disclaimer, the term of this patent is extended or adjusted under 35 U.S.C. 154(b) by 0 days.

(21) Appl. No.: 16/400,212

(22) Filed: May 1, 2019

(51) Int. Cl.

| | |
|---|---|
| ***A63F 1/10*** | (2006.01) |
| ***A45C 11/18*** | (2006.01) |
| ***A63F 3/06*** | (2006.01) |
| *A63F 1/06* | (2006.01) |

(52) U.S. Cl.
CPC ..... *A63F 1/10* (2013.01); *A45C 11/18* (2013.01); *A63F 3/062* (2013.01); *A63F 1/067* (2013.01); *A63F 3/06* (2013.01); *A63F 3/065* (2013.01); *A63F 3/0605* (2013.01); *A63F 3/0625* (2013.01)

(58) Field of Classification Search
CPC ..... A63F 3/0625; A63F 3/062; A63F 3/065; A63F 3/0605; A63F 3/06; A63F 1/067; A63F 1/10
USPC ..... 273/286, 285, 287, 148 A, 148 R
See application file for complete search history.

(56) References Cited

U.S. PATENT DOCUMENTS

| | | | | | |
|---|---|---|---|---|---|
| 2,872,215 | A * | 2/1959 | Taylor | A63F 3/0625 | 273/309 |
| 4,502,658 | A * | 3/1985 | Wirt | A63F 3/0625 | 16/366 |
| 4,630,830 | A | 12/1986 | Gadd | | |
| 4,832,372 | A * | 5/1989 | Young | A45C 1/00 | 150/139 |
| 5,044,100 | A * | 9/1991 | Roberts | B42F 5/04 | 40/735 |
| 5,082,116 | A * | 1/1992 | Schanne | A63F 1/00 | 206/579 |
| 5,431,207 | A * | 7/1995 | Siegel | A45C 1/06 | 150/139 |
| 5,984,092 | A | 11/1999 | Heard-Willmon | | |
| 6,282,826 | B1 | 9/2001 | Richards | | |
| 2001/0019206 | A1 * | 9/2001 | Deans | B42F 7/06 | 281/2 |
| 2004/0245719 | A1 | 12/2004 | Petralia | | |
| 2006/0289330 | A1 | 12/2006 | Seism | | |
| 2009/0250495 | A1 | 10/2009 | Sonnier | | |
| 2012/0104693 | A1 * | 5/2012 | Ayagalria | A63F 3/0635 | 273/269 |
| 2012/0227299 | A1 * | 9/2012 | Bauer | A47G 1/065 | 40/735 |
| 2014/0259839 | A1 * | 9/2014 | Tatum | G09F 7/08 | 40/711 |

* cited by examiner

*Primary Examiner* — Benjamin Layno

(57) ABSTRACT

A bingo card organizing assembly for storing bingo cards, flash cards or any other type of gaming card includes a first panel a set of first pockets. Each of the first pockets is attached to the first panel to contain a bingo card. Each of the first pockets is comprised of a translucent material to facilitate the bingo cards to be visible through the first pockets. A set of second pockets is each of the second pockets is attached to the first panel to contain a flash card. Each of the second pockets is comprised of a translucent material to facilitate the flash cards to be visible through the second pockets. A pair of third pockets is each coupled to the first panel. A second panel has the first panel being coupled thereto and the second panel lies on a support surface when the first and second panels are unfolded.

7 Claims, 4 Drawing Sheets

BINGO CARD ORGANIZING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to organizing devices and more particularly pertains to a new organizing device for bingo cards, flash cards and any other type of gaming card.

BRIEF SUMMARY OF THE INVENTION

An embodiment of the disclosure meets the needs presented above by generally comprising a first panel a set of first pockets. Each of the first pockets is attached to the first panel to contain a bingo card. Each of the first pockets is comprised of a translucent material to facilitate the bingo cards to be visible through the first pockets. A set of second pockets is each of the second pockets is attached to the first panel to contain a flash card. Each of the second pockets is comprised of a translucent material to facilitate the flash cards to be visible through the second pockets. A pair of third pockets is each coupled to the first panel. A second panel has the first panel being coupled thereto and the second panel lies on a support surface when the first and second panels are unfolded.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
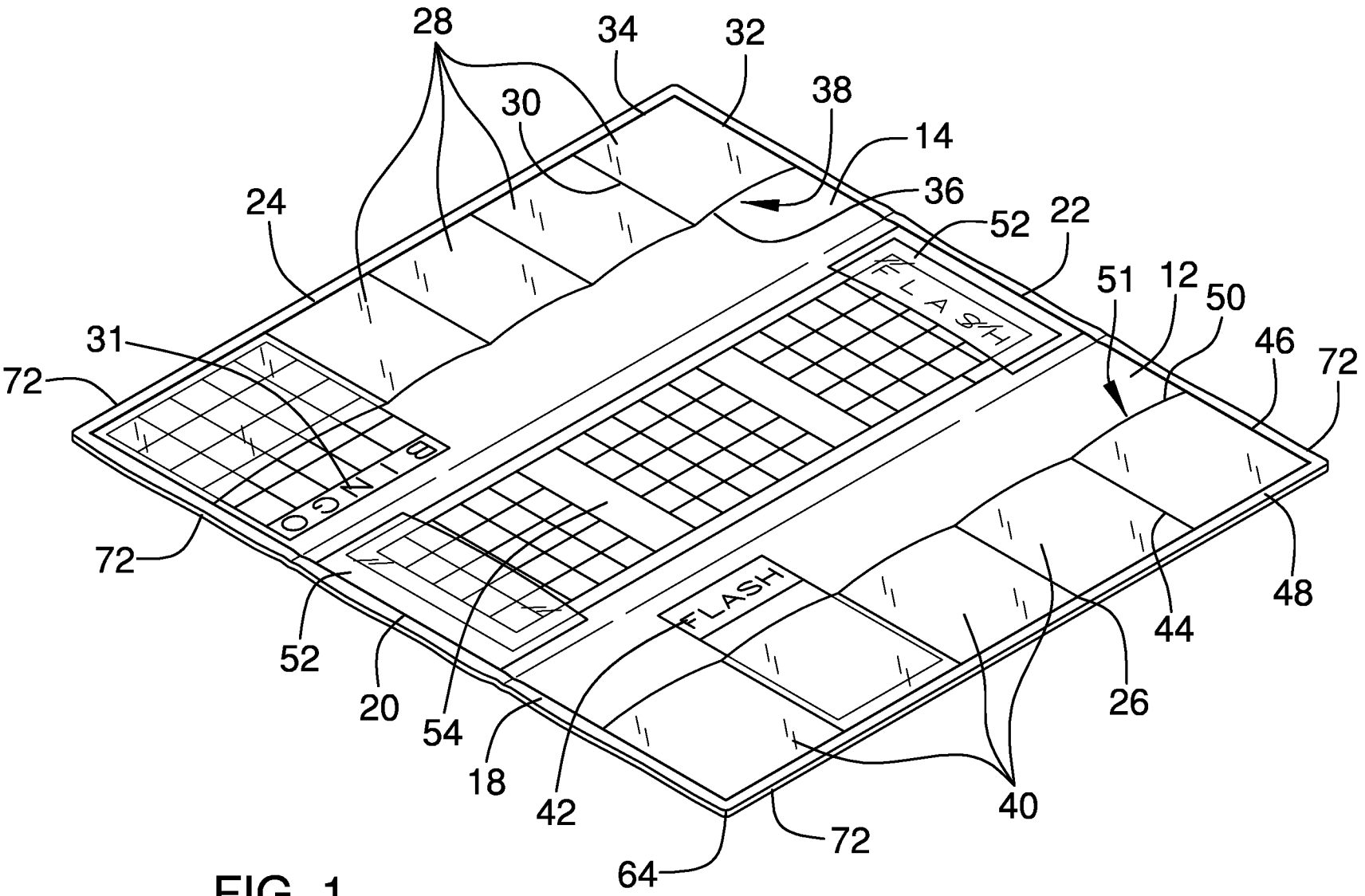
FIG. 1 is a top perspective view of a bingo card organizing assembly according to an embodiment of the disclosure.
Figures 2, 3:
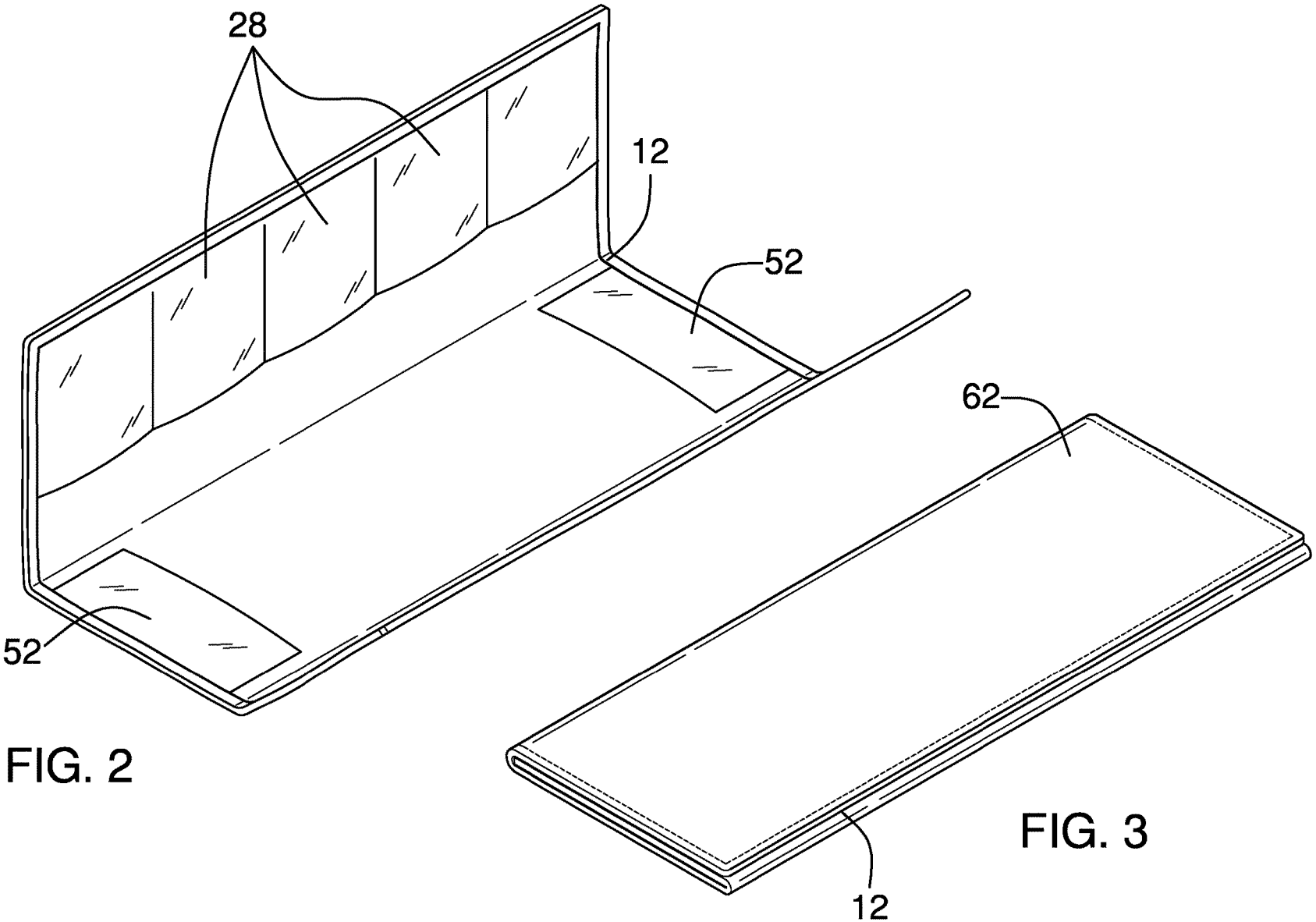
FIG. 2 is a perspective view of an embodiment of the disclosure showing each of a first and second panel being unfolded.
FIG. 3 is a perspective view of an embodiment of the disclosure showing each of a first and second panel being folded.
Figure 5:
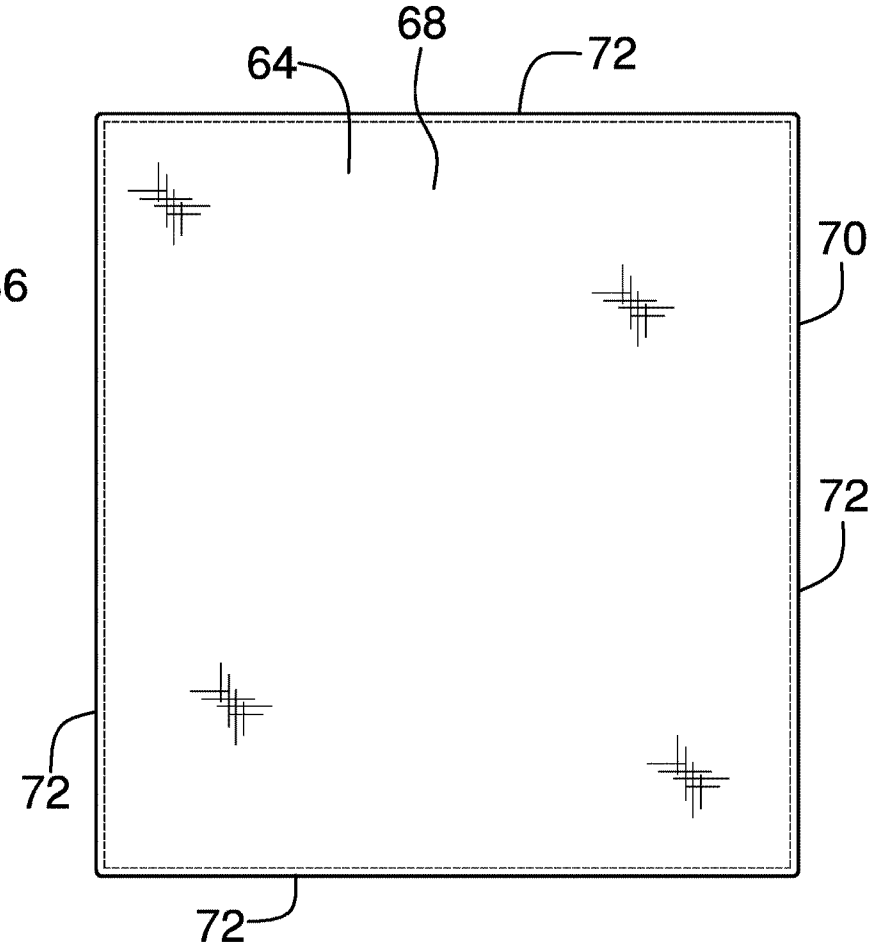
FIG. 5 is a bottom view of an embodiment of the disclosure.
Figure 4:
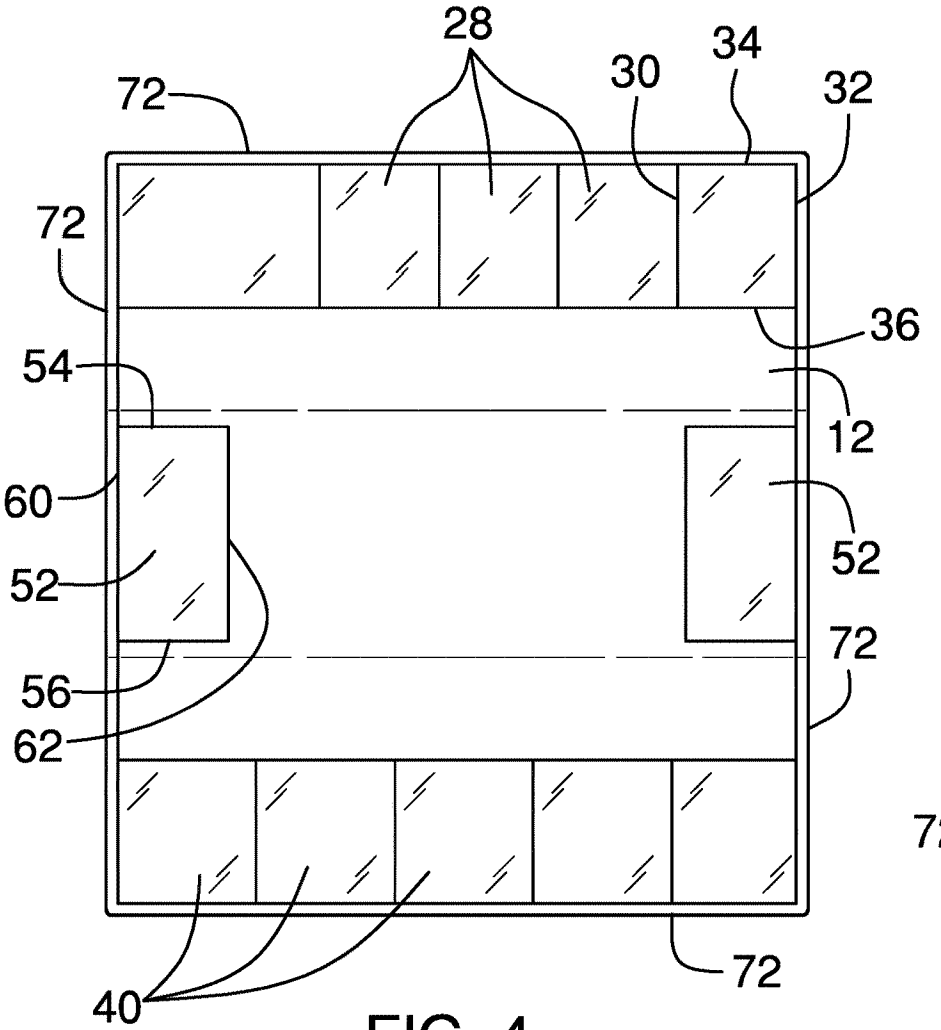
FIG. 4 is a top view of an embodiment of the disclosure.
Figure 6:
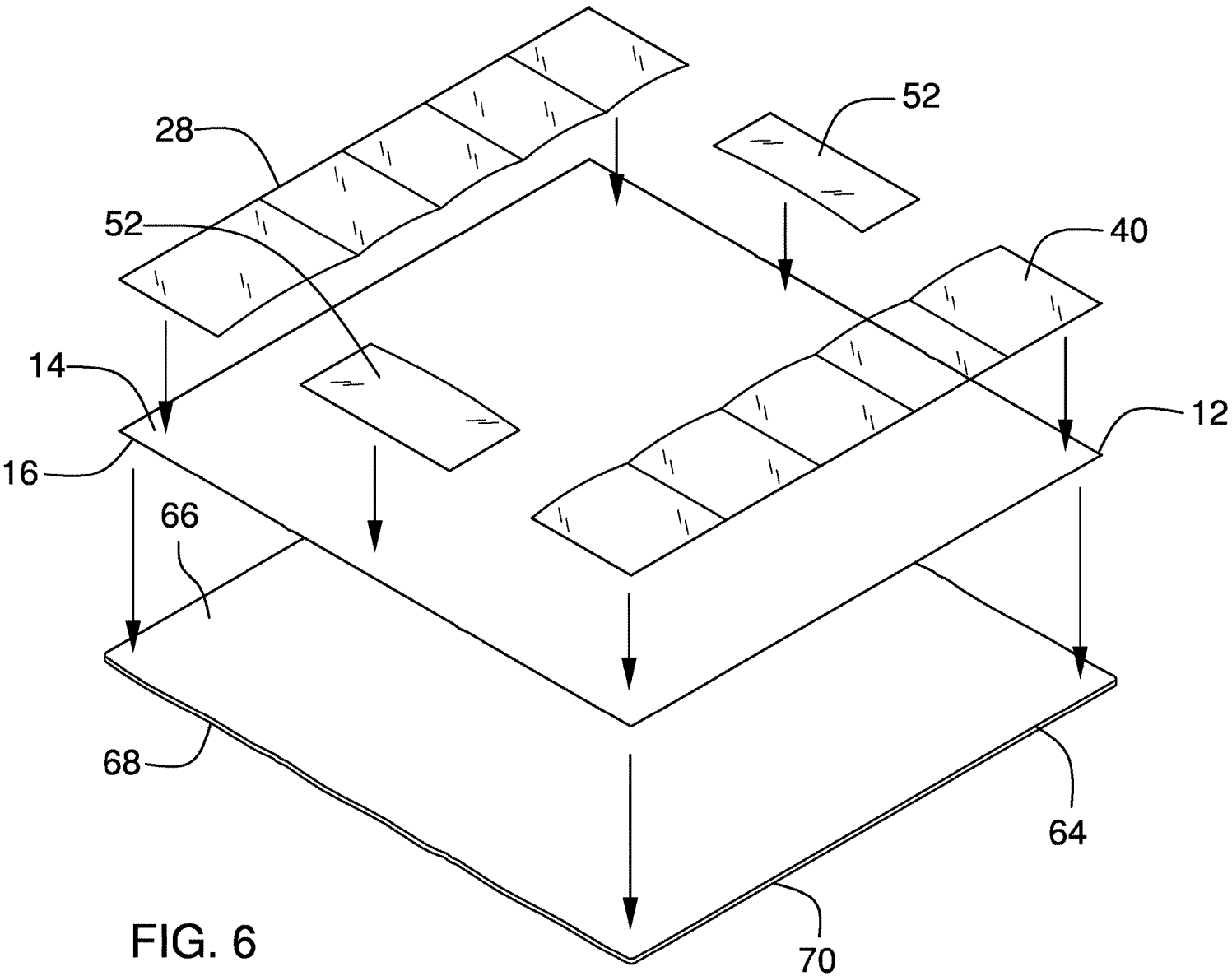
FIG. 6 is an exploded perspective view of an embodiment of the disclosure.

With reference now to the drawings, and in particular to FIGS. 1 through 6 thereof, a new organizing device embodying the principles and concepts of an embodiment of the disclosure and generally designated by the reference numeral 10 will be described.

As best illustrated in FIGS. 1 through 6, the bingo card organizing assembly 10 generally comprises a first panel 12 that is comprised of a deformable material, such as cotton or other textile, thereby facilitating the first panel 12 to be folded for storage. The first panel 12 has a top side 14, a bottom side 16 and a perimeter edge 18, and the perimeter edge 18 has a front side 20, a back side 22, a first lateral side 24 and a second lateral side 26 such that the first panel 12 has a rectangular shape. A set of first pockets 28 is each attached to the first panel 12 and each of the first pockets 28 can contain a bingo card 31. Each of the first pockets 28 is comprised of a translucent material to facilitate the bingo card 31*s* to be visible through the first pockets 28.

Each of the first pockets 28 has a first lateral edge 30, a second lateral edge 32, a bottom edge 34 and a top edge 36. Each of the first lateral 30, second lateral 32 and bottom 34 edges of each of the first pockets 28 is sewn to the top side 14 of the first panel 12. The top edge 36 of each of the first pockets 28 is loose from the first panel 12 to define an opening 38 into the first pockets 28. The bottom edge 34 of each of the first pockets 28 is aligned the first lateral side 24 of the perimeter edge 18 of the first panel 12. Moreover, each of the first pockets 28 is distributed along an entire length of the first lateral side 24.

A set of second pockets 40 is each attached to the first panel 12 and each of the second pockets 40 can contain a flash card 42. The flash card 42 may be a game card of any conventional design that is not a bingo card 31. Each of the second pockets 40 is comprised of a translucent material to facilitate the flash card 42 to be visible through the second pockets 40. Each of the second pockets 40 has a first lateral edge 44, a second lateral edge 46, a bottom edge 48 and a top edge 50. Each of the first lateral 44, second lateral 46 and bottom 48 edges of each of the second pockets 40 is sewn to the top side 14 of the first panel 12.

The top edge 50 of each of the second pockets 40 is loose from the first panel 12 to define an opening 51 into the second pockets 40. The bottom edge 48 of each of the second pockets 40 is aligned the second lateral side 26 of the perimeter edge 18 of the first panel 12. Each of the second pockets 40 is distributed along an entire length of the second lateral side 26.

A pair of third pockets 52 is each coupled to the first panel 12. The third pockets 52 are aligned with each other and are spaced apart from each other on the first panel 12. Thus, each of the third pockets 52 can have a strip 54 positioned in and extending between each of the third pockets 52. The strip 54 may be an elongated game card or any other elongated game piece. Each of the third pockets 52 is positioned between the sets of first 28 and second 40 pockets and each of the third pockets 52 is comprised of a translucent material.

Each of the third pockets 52 has a first lateral edge 56, a second lateral edge 58, a bottom edge 60 and a top edge 62. Each of the first lateral 56, second lateral 58 and bottom 60 edges of each of the third pockets 52 is sewn to the top side 14 of the first panel 12. The bottom edge 60 of each of the third pockets 52 is aligned with a respective one of the front 20 and back 22 sides of the perimeter edge 18 of the first panel 12. In this way the top edge 62 of each of the third pockets 52 is directed toward each other. Additionally, each of the first 28, second 40 and third 52 pockets is sewn to the first panel 12 in a manner that inhibits stitching from being visible on the top side 14 of the first panel 12.

A second panel 64 is provided and the first panel 12 is coupled to the second panel 64. The second panel 64 lies on a support surface, such as a table or the like, when the first 12 and second 64 panels are unfolded. The second panel 64 is comprised of a deformable material thereby facilitating each of the first 12 and second 64 panels to be foldable onto themselves for storage. The second panel 64 has an upper side 66, a lower side 68 and a peripheral edge 70 extending therebetween, and the upper side 66 is bonded to the bottom side 16 of the first panel 12.

The peripheral edge 70 has a plurality of intersecting sides 72 that are oriented at a right angle with each other such that the second panel 64 has a rectangular shape. The second panel 64 has a length and a width is greater than a length and width of the first panel 12. Thus, each of the intersecting sides 72 of the peripheral edge 70 is spaced outwardly from and is oriented collinear with a respective one of the first lateral 24, second lateral 26, front 20 and back 22 sides of the perimeter edge 18 of the first panel 12.

In use, bingo cards 31 are positioned in each of the first pockets 28 for storage and organization. Additionally, the bingo cards 31 are visible through each of the first pockets 28. In this way bingo cards 31 that have already been used can be observed without having the bingo cards 31 that have already been used spread out on a table. In this way the bingo cards 31 remain organized while they are being used. Flash cards 42 are positioned in each of the second pockets 40 for storage. The flash cards 42 are visible through the second pockets 40 thereby facilitating the flash cards 42 to be observed when the flash cards 42 are in the second pockets 40. One or more of the strips 54 can be stored in the third pockets 52. Each of the first 12 and second 64 panels are folded lengthwise in bi-fold configuration for storage. Moreover, each of the bingo cards 31, the flash cards 42 and the strips 54 are retained in the respective first 28, second 40 and third 52 pockets when the first 12 and second 64 panels are folded for storage.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bingo card organizing assembly being configured to store and display bingo cards and bingo strips, said assembly comprising:

a first panel being comprised of a deformable material thereby facilitating said first panel to be folded for storage, said first panel having a top side, a bottom side and a perimeter edge, said perimeter edge having a front side, a back side, a first lateral side and a second lateral side such that said first panel has a rectangular shape;

a set of first pockets, each of said first pockets being attached to said first panel wherein each of said first pockets is configured to contain a bingo card, each of said first pockets being comprised of a translucent material wherein each of said first pockets is configured to facilitate the bingo cards to be visible through said first pockets, each of said first pockets having a first lateral edge, a second lateral edge, a bottom edge and a top edge, each of said first lateral, second lateral and bottom edges of each of said first pockets being sewn to said top side of said first panel having said top edge of each of said first pockets defining an opening into said first pockets;

a set of second pockets, each of said second pockets being attached to said first panel wherein each of said second pockets is configured to contain a flash card, each of said second pockets being comprised of a translucent material wherein each of said second pockets is configured to facilitate the flash cards to be visible through said second pockets;

a pair of third pockets, each of said third pockets being coupled to said first panel, said third pockets being aligned with each other and being spaced apart from each other on said first panel wherein each of said third pockets is configured to have a strip positioned in and extending between each of said third pockets, each of said third pockets being positioned between said sets of first and second pockets, each of said third pockets being comprised of a translucent material, each of said third pockets has a first lateral edge, a second lateral edge, a bottom edge and a top edge, each of said first lateral, second lateral and bottom edges of each of said third pockets being sewn to said top side of said first panel, said bottom edge of each of said third pockets being aligned with a respective one of said front and back sides of said perimeter edge of said first panel such that said top edge of each of said third pockets is directed toward each other; and a second panel having said first panel being coupled thereto wherein said second panel is configured to lie on a support surface when said first and second panels are unfolded, each of said first and second panels being foldable onto themselves for storage.

2. The assembly according to claim 1, wherein:

said bottom edge of each of said first pockets is aligned said first lateral side of said perimeter edge of said first panel; and each of said first pockets is distributed along an entire length of said first lateral side.

3. The assembly according to claim 1, wherein each of said second pockets has a first lateral edge, a second lateral edge, a bottom edge and a top edge, each of said first lateral, second lateral and bottom edges of each of said second pockets being sewn to said top side of said first panel having said top edge of each of said second pockets defining an opening into said second pockets.

4. The assembly according to claim 3, wherein:

said bottom edge of each of said second pockets is aligned said second lateral side of said perimeter edge of said first panel; and each of said second pockets is distributed along an entire length of said second lateral side.

5. The assembly according to claim 1, wherein said second panel has an upper side, a lower side and a peripheral edge extending therebetween, said upper side being bonded to said bottom side of said first panel, said peripheral edge having a plurality of intersecting sides being oriented at a right angle with each other such that said second panel has a rectangular shape.

6. The assembly according to claim 5, wherein said second panel has a length and a width being greater than a length and width of said first panel, each of said intersecting sides of said peripheral edge being spaced outwardly and being oriented collinear with a respective one of said first lateral, second lateral, front and back sides of said perimeter edge of said first panel.

7. A bingo card organizing assembly being configured to store and display bingo cards and bingo strips, said assembly comprising:

a first panel being comprised of a deformable material thereby facilitating said first panel to be folded for storage, said first panel having a top side, a bottom side and a perimeter edge, said perimeter edge having a front side, a back side, a first lateral side and a second lateral side such that said first panel has a rectangular shape;

a set of first pockets, each of said first pockets being attached to said first panel wherein each of said first pockets is configured to contain a bingo card, each of said first pockets being comprised of a translucent material wherein each of said first pockets is configured to facilitate the bingo cards to be visible through said first pockets, each of said first pockets having a first lateral edge, a second lateral edge, a bottom edge and a top edge, each of said first lateral, second lateral and bottom edges of each of said first pockets being sewn to said top side of said first panel having said top edge of each of said first pockets defining an opening into said first pockets, said bottom edge of each of said first pockets being aligned said first lateral side of said perimeter edge of said first panel, each of said first pockets being distributed along an entire length of said first lateral side;

a set of second pockets, each of said second pockets being attached to said first panel wherein each of said second pockets is configured to contain a flash card, each of said second pockets being comprised of a translucent material wherein each of said second pockets is configured to facilitate the flash cards to be visible through said second pockets, each of said second pockets having a first lateral edge, a second lateral edge, a bottom edge and a top edge, each of said first lateral, second lateral and bottom edges of each of said second pockets being sewn to said top side of said first panel having said top edge of each of said second pockets defining an opening into said second pockets, said bottom edge of each of said second pockets being aligned said second lateral side of said perimeter edge of said first panel, each of said second pockets being distributed along an entire length of said second lateral side;

a pair of third pockets, each of said third pockets being coupled to said first panel, said third pockets being aligned with each other and being spaced apart from each other on said first panel wherein each of said third pockets is configured to have a strip positioned in and extending between each of said third pockets, each of said third pockets being positioned between said sets of first and second pockets, each of said third pockets being comprised of a translucent material, each of said third pockets having a first lateral edge, a second lateral edge, a bottom edge and a top edge, each of said first lateral, second lateral and bottom edges of each of said third pockets being sewn to said top side of said first panel, said bottom edge of each of said third pockets being aligned with a respective one of said front and back sides of said perimeter edge of said first panel such that said top edge of each of said third pockets is directed toward each other; and a second panel having said first panel being coupled thereto wherein said second panel is configured to lie on a support surface when said first and second panels are unfolded, each of said first and second panels being foldable onto themselves for storage, said second panel having an upper side, a lower side and a peripheral edge extending therebetween, said upper side being bonded to said bottom side of said first panel, said peripheral edge having a plurality of intersecting sides being oriented at a right angle with each other such that said second panel has a rectangular shape, said second panel having a length and a width being greater than a length and width of said first panel, each of said intersecting sides of said peripheral edge being spaced outwardly and being oriented collinear with a respective one of said first lateral, second lateral, front and back sides of said perimeter edge of said first panel.

* * * * *